US005598722A

United States Patent [19]

Leach, II et al.

[11] Patent Number: 5,598,722

[45] Date of Patent: Feb. 4, 1997

[54] BANGLE CLOSING MECHANISM

[75] Inventors: Edwin F. Leach, II; Marinko Markic, both of Attleboro, Mass.; Ronald E. Precourt, Jr., Woonsocket, R.I.; Michael A. Gayton, Sandwich; Dwarika P. Agarwal, Attleboro, both of Mass.

[73] Assignee: Leach & Garner Company, North Attleboro, Mass.

[21] Appl. No.: 415,645

[22] Filed: Apr. 3, 1995

[51] Int. Cl.[6] ..... A44C 5/00

[52] U.S. Cl. ..... 63/7; 24/68 J

[58] Field of Search ..... 63/3, 4, 6, 7; 24/614, 24/615, 616, 68 J

[56] References Cited

U.S. PATENT DOCUMENTS

| | | | |
|---|---|---|---|
| 231,235 | 8/1880 | Murray . | |
| 291,519 | 1/1884 | Jones | 63/7 |
| 1,054,401 | 2/1913 | Eklund | 63/7 |
| 1,142,070 | 6/1915 | Wiedmann | 63/7 |
| 4,336,384 | 12/1980 | Daub | 63/7 |

FOREIGN PATENT DOCUMENTS

| | | | |
|---|---|---|---|
| 261600 | 12/1928 | Italy | 24/685 |
| 64748 | 1/1913 | Switzerland | 24/616 |
| 21466 | of 1898 | United Kingdom | 24/616 |

*Primary Examiner*—Flemming Saether

*Attorney, Agent, or Firm*—Phillips, Lytle, Hitchcock, Blaine & Huber

[57] ABSTRACT

An improved bangle closing mechanism (26) is adapted to releasably join two tubular arcuate bangle halves (11, 12). The improved closing mechanism has a keeper bar (28) provided with a proximal portion (29) adapted to be operatively engaged with the first bangle half (11), an intermediate portion (30) extending between the bangle halves and penetrating a narrowed opening (23) in the second bangle half (12), and an enlarged ball-like head portion (31) operatively arranged within the second bangle half. The projected diameter ($d_1$) of the head portion is greater than the projected diameter ($d_2$) of the narrowed opening. The head portion prevents the keeper bar from being withdrawn from the second bangle half, and facilitates sliding movement within the second bangle half as to the bangle halves are moved relatively toward or away from one another.

17 Claims, 2 Drawing Sheets

BANGLE CLOSING MECHANISM

TECHNICAL FILED

The present invention relates generally to the field of bangles and closures therefor, and, more particularly, to an improved closing mechanism that is adapted to releasably join two arcuate tubular bangle halves.

BACKGROUND ART

There are many types of bangles, that is, bracelets, anklets, and the like. Some of these have one or more arcuate sections, and are adapted to releasably encircle a body parts, such as a neck, ankle or wrist. In some cases, a bangle closing mechanism (i.e., a mechanism or device for joining two adjacent bangle sections) may simply be a chain, a clasp, a hook, or the like. In other cases, it is necessary to provide a more complicated mechanism.

This problem is compounded when the adjacent bangle halves are arcuate and tubular. In this case, it is often desirable to have the bangle closing mechanism appear as a smooth, substantially-continuous extension of the two arcuate tubular bangle halves. Thus, the bangle closing mechanism must be both functional and decorative.

It has heretofore been known to provide a bangle closing mechanism for arcuate tubular bangle halves in the form of an elongated keeper bar. The keeper bar had an out-turned distal end that simulated the shape or appearance of an L-shaped hook. This hook end portion was arranged within one of the bangle halves. An intermediate portion of the keeper bar was passed through an opening provided in the associated bangle half, and spanned the gap between the two halves. The other marginal end portion of the keeper bar was configured as a catch member that included two spring-biased tines. The free ends of these tines were adapted to be squeezed together to permit insertion of the same into a complimentarily-configured opening in the other bangle half. The keeper bar was formed so as to be either straight, or to have a plurality of series-connected linear segments (i.e., an open polygonal configuration). With these prior art embodiments, it was Applicants' experience that the hook end portion of the keeper bar often experienced difficulty in sliding along the inside of the bangle half in which it was located. In other words, the out-turned hook portion seemed to inhibit free sliding movement of the keeper bar within the associated bangle half. At the same time, it was also Applicants' experience that the integral spring that biased the tines to move apart, was unduly stiff.

Accordingly, it would be generally desirable to provide an improved bangle closing mechanism that overcomes these defects noted in the prior art.

DISCLOSURE OF THE INVENTION

With parenthetical reference to the corresponding parts, portions or surfaces of the disclosed embodiment, merely for purposes of illustration and not by way of limitation, the present invention broadly provides an improved bangle closing mechanism (26) for releasably holding a first tubular bangle half (11) to a second tubular bangle half (12). The second bangle half has a narrowed opening (23) in a marginal end portion (24).

The improved bangle closing mechanism (26) includes an improved keeper bar (28) having one marginal end portion (29) operatively secured to the first bangle half. The keeper bar has an intermediate portion (30) slidably penetrating the narrowed opening in the second bangle half, and has an enlarged ball-like head (31) mounted on its distal end. The projected diameter ($d_1$) of this head is greater than the projected diameter ($d_2$) of the second bangle half narrowed opening. The enlarged head prevents the keeper bar from being withdrawn from the second bangle half, and facilitates sliding movement of the keeper bar within the second bangle half when the two bangle halves are moved relatively toward and away from one another.

The ball-like head (31) may be a substantially-spherical ball, perhaps formed integrally with the keeper bar. In one form, the entire keeper bar is formed of Leach & Garner Gold™, a trademark of Leach & Garner Company, 57 John L. Dietsch Square, Attleboro, Mass. 02763. More particularly, as used herein Leach & Garner Gold™ refers to an alloy falling within the scope of at least one claim of U.S. Pat. No. 5,180,551, the aggregate disclosure of which is hereby incorporated by reference. The ball-like head may be formed by selectively heating the distal marginal end portion of the keeper bar to form the bead-like head portion thereon. The keeper bar may have a substantially-rectangular transverse cross-section that is bounded by a major dimension (h) and by a minor dimension (w). The keeper bar may be arcuate such that the surfaces which include the minor dimensions are substantially planar and parallel, but that one of the major dimension surfaces is concave and the other major dimension surface is convex. The keeper bar may be similarly arcuate, and bent about substantially the same radius as the bangle halves. The first bangle half may have a pair of openings adapted to receive the proximal end of the keeper bar. The proximal end may include two fork-like tines, the free ends of which may be squeezed together to facilitate insertion and withdrawal from an associated opening. If desired, the proximal marginal end portion may be provided with an enlarged-diameter arcuate surface proximate the pivot point, to reduce the spring rate such that the relative flexibility of the tines will be improved.

Accordingly, the general object of this invention is to provide an improved bangle closing mechanism.

Another object is to provide an improved bangle closing mechanism that is particularly adapted for use with arcuate tubular bangle halves.

Still another object is to provide an improved bangle closing mechanism having a ball-like head on its distal end portion to prevent withdrawal of the keeper bar from one of the bangle halves, and to facilitate relative sliding movement of such distal end within the associated bangle half when the two bangle halves are moved relatively toward and away from one another.

These and other objects and advantages will become apparent from the foregoing and ongoing written specification, the drawings, and the appended claims.

DESCRIPTION OF THE PREFERRED EMBODIMENTS

Figure 1:
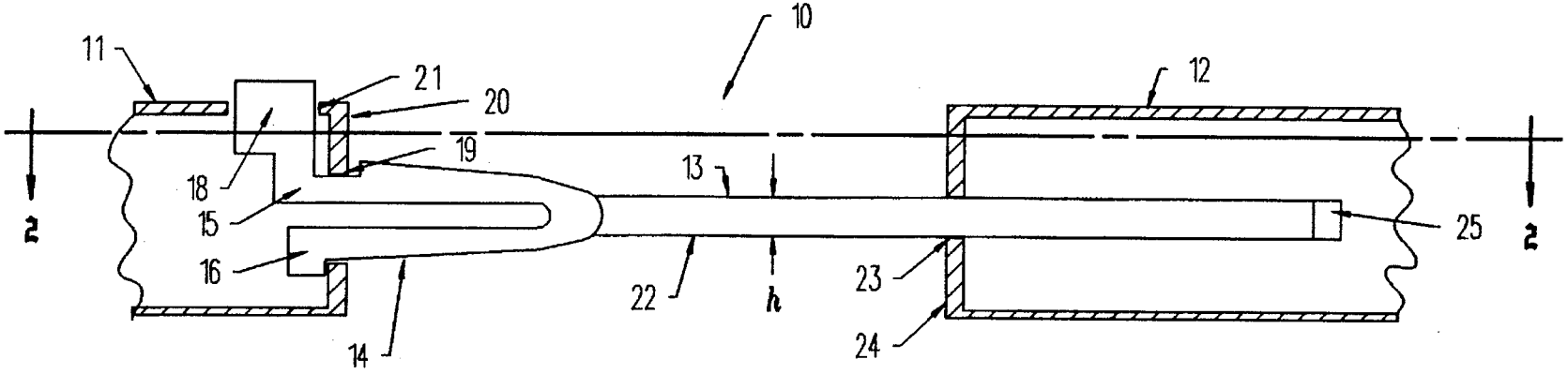
Fig. 1 (PRIOR ART)
FIG. 1 is a fragmentary vertical view, partly in elevation and partly in longitudinal cross-section, of a prior art bangle closing mechanism in association with two tubular bangle halves, this view showing the two-piece assembled keeper bar in elevation.

At the outset, it should be clearly understood that like reference numerals are intended to identify the same structural elements, portions or surfaces consistently throughout the several drawings figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 2:
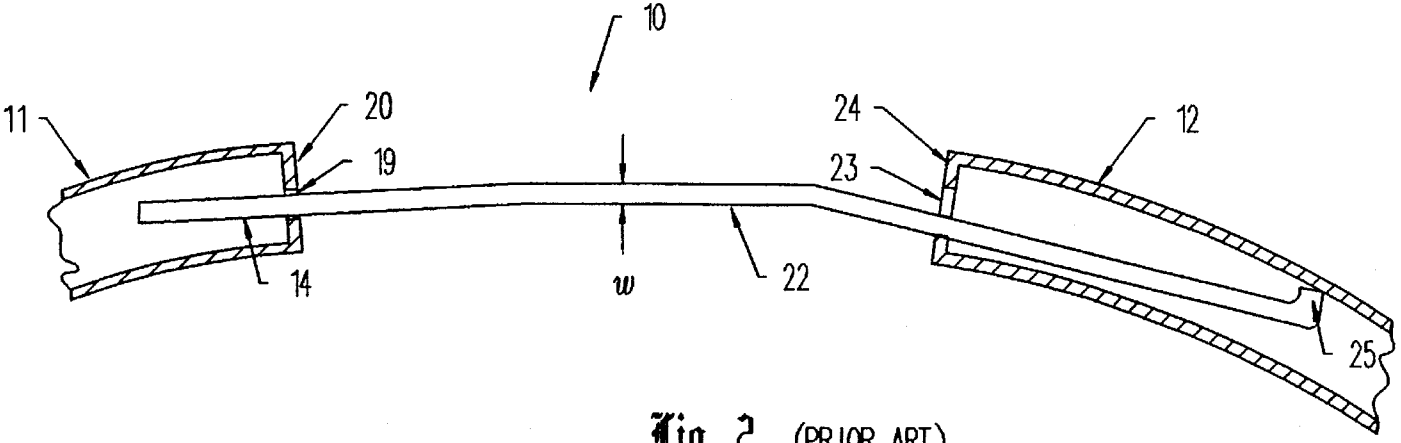
Fig. 2 (PRIOR ART)
FIG. 2 is a fragmentary horizontal view thereof, taken generally on line 2—2 of FIG. 1, showing the series-connected linear segments of the prior art keeper bar and the out-turned hook-like distal end portion thereof.

Turning now to the drawings, and, more particularly, to the prior art arrangement shown in FIGS. 1 and 2 thereof, a prior art bangle closing mechanism, generally indicated at 10, is depicted as operatively joining a leftward or first tubular bangle half 11 to a rightward or second tubular bangle half 12. The prior art device is shown as having an assembled two-piece keeper bar, generally indicated at 13, releasably joining the two bangle halves. The left or proximal marginal end portion of the keeper bar, this being indicated at 14, has a pair of vertically-spaced leftwardly-extending spring-biased tines 15, 16, and an actuation tab 18. The leftward or free ends of tines 15, 16 are adapted to be selectively passed through an opening 19 in the right marginal end portion 20 of the leftward bangle half. Tab 18 is adapted to extend upwardly through a radial opening 21 provided through the tubular wall of the associated bangle half.

Keeper bar 13 is also shown as having an intermediate rod-like portion, generally indicated at 22, which extends rightwardly from the proximal portion 14, and which extends through an opening 23 in the left marginal end wall 24 of the right bangle half 12, and which terminates in an out-turned L- or hook-shaped right or distal end portion 25. This hook-shaped end portion was intended to prevent the keeper bar from being unintentionally withdrawn through right bangle half hole 23. However, as will be readily appreciated, it was possible for the keeper bar to be manipulated to a position at which the hook could be unintentionally withdrawn from the right keeper half. In addition to this, the out-turned hook end portion had relatively-sharp edges which appeared to inhibit free sliding movement of the keeper bar within the rightward or second bangle half. This sliding impediment may have been further facilitated by the fact that the keeper bar was formed as a series of linear segments, as illustrated in FIG. 2.

In addition to this, it was Applicants' experience that considerable force was required to squeeze the two ends of the tines 15, 16 together so as to allow the proximal end portion to be connected or disconnected with the leftward bangle half.

Figure 3:
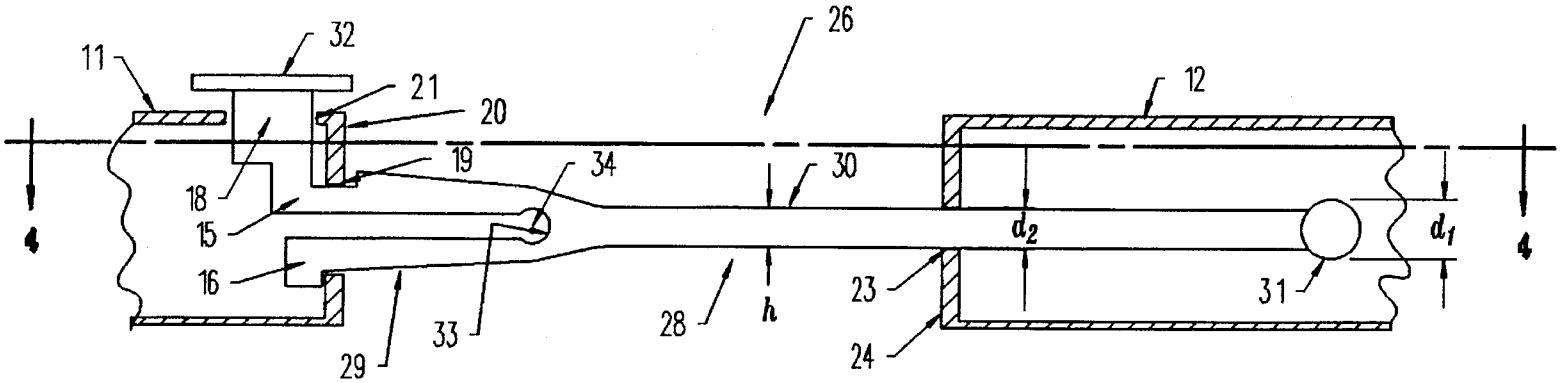
FIG. 3 is a fragmentary vertical view, again partly in elevation and partly in longitudinal cross-section, of an improved bangle closing mechanism, this view showing the unitary keeper bar in elevation, as having its proximal marginal end portion operatively engaged with the left bangle half, having an intermediate portion passing through a narrowed opening in the left end wall of the right or second bangle half, and as having an enlarged ball-like head on its distal marginal end portion.
Figure 4:
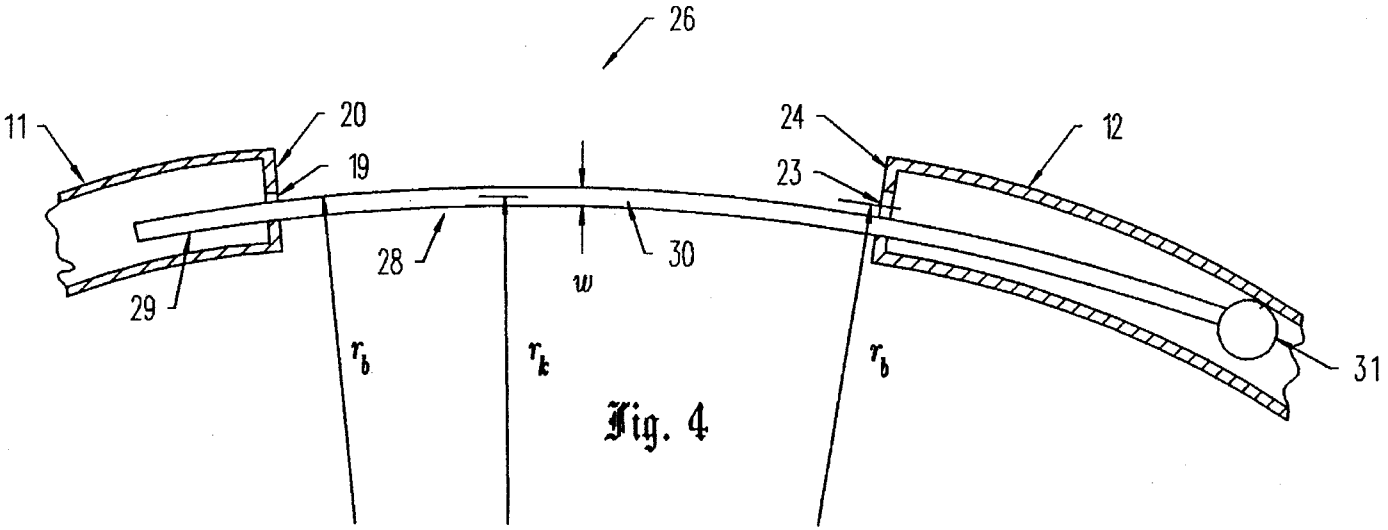
FIG. 4 is a fragmentary horizontal sectional view thereof, taken generally on line 4—4 of FIG. 3.

The improved bangle closing mechanism is generally indicated at 26 in FIGS. 3 and 4. Here again, the improved mechanism includes a keeper bar, generally indicated at 28, which is used to selectively couple and uncouple the two marginal end portions of left and right bangle halves 11, 12, respectively. Since the two bangle halves have been previously described, it is assumed that the reader will correlate the same reference with structure previously described. Hence, such structure will not be redescribed herein.

The improved keeper bar 28 again has a leftward proximal marginal end portion 29, an intermediate bar-like portion 30, and a rightward or distal end portion 31. However, in the improved device, a pusher plate 32, which appears to be round, oval or polygonal when seen in top plan, is affixed to the upper surface of actuation tab 18. Moreover, the proximal end portion 29 is provided with an enlarged arcuate surface, generally indicated at 33, proximate the flexure point 34, to facilitate pivotal movement of the free ends of the tines relatively toward one another. In addition to this, the entire keeper bar is lo formed integrally of a single material, such as Leach & Garner Gold™. This alloy has unique properties, and is more fully disclosed an claimed in U.S. Pat. No. 5,180,551, the aggregate disclosure of which is hereby incorporated by reference. The keeper bar intermediate portion 30 has a substantially-rectangular transverse cross-section that is bounded by a major dimension, indicated at h in FIG. 3, and a minor dimension, indicated at w in FIG. 4. The keeper bar is also shown as being bent laterally to form an arcuate segment, with the radius of the keeper bar $r_k$ being substantially the same as the radius of either bangle half $r_b$, so that the keeper bar appears to be a smooth continuous extension thereof.

Another difference is that the distal or right marginal end portion of the keeper bar is provided with an enlarged ball-like head, this being generally indicated at 31. This head is a substantially-spherical ball, and is preferably formed integrally with the keeper bar. In practice, and particularly where the keeper bar is formed of Leach & Garner Gold™, the ball-like head may be formed by heating the distal end portion of the keeper bar to form a bead-like portion at its distal end. This ball 31 has a projected diameter ($d_1$) that is greater than the projected diameter ($d_2$) of opening 23. Thus, the right marginal end portion of the keeper bar is constrained from passing through opening 23. Thus, the keeper bar cannot separate from the right bangle half, no matter how it is articulated. At the same time, the rounded shape of the keeper bar facilitates sliding movement of the keeper bar within the right bangle half as the two bangle halves are moved relatively toward and away from one another.

Modifications

The present invention contemplates that many changes and modifications may be made. For example, the ball-like head on the end of the keeper bar need not necessarily be formed integrally therewith. Alternatively, it can be formed separately, and subsequently assembled or mounted on the keeper bar. Indeed, it can be formed of the same material or a different material. It need not necessarily be spherical. The keeper bar itself may have a substantially-rectangular cross-section, as shown, or may have some other round or polygonal transverse cross-section, as desired. While it is presently preferred that the keeper bar be bent to form an arcuate segment, this need not invariably obtain. Similarly, the proximal marginal end portion may be formed to have the particular spring-biased tines, as shown in the accompanying drawing. On the other hand, it may have some other shape or form as well. As indicated above, the keeper bar may be formed integrally of a single material, such as (but not limited to) Leach & Garner Gold™ The keeper may be formed arcuately or in segments, as desired.

Therefore, while the preferred form of the improved bangle closing mechanism as been shown and described, and several modifications thereof discussed, persons skilled in this art will readily appreciate the various additional changes and modifications may be made without departing from the spirit of the invention, as defined and differentiated by the following claims.

What is claimed is:

1. A bangle closing mechanism for releasably holding an arcuate first tubular bangle half to an arcuate second tubular bangle half, said second bangle half having a narrowed opening in a marginal end portion, comprising:

a keeper bar fixedly mounted to said first arcuate bangle half, said keeper bar having an intermediate portion slidably penetrating said narrowed opening and having an enlarged substantially-spherical head mounted on its distal end, the largest diameter of said spherical head when projected into a plane being greater than the largest diameter of said narrowed opening when projected into said plane;

whereby said enlarged head will prevent said keeper bar from being withdrawn from said second arcuate bangle half and will facilitate sliding movement of said keeper bar within said second arcuate bangle half when said arcuate bangle halves are moved relatively toward or away from one another.

2. A bangle closing mechanism as set forth in claim 1 wherein said head is formed integrally with said keeper bar.

3. A bangle closing mechanism as set forth in claim 2 wherein said head is formed by heating said keeper bar distal marginal end portion to form a bead-like portion at said distal end.

4. A bangle closing mechanism as set forth in claim 2 wherein said keeper bar is formed of a hardenable gold-based alloy composition, consisting essentially of:

not less than about 58.03 weight percent gold;

not less than about 10.0 weight percent silver;

not less than about 2.0 weight percent zinc;

not less than about 0.2 weight percent cobalt;

copper in weight percent amount equal to 100 less the sum total of the weight percent of said gold, silver, zinc and cobalt;

the ratio of said copper amount to said silver amount being between about 2.0 and about 3.8;

the ratio of said copper amount to the sum total of said silver amount plus twice said zinc amount being between about 1.3 and about 2.5;

said composition having a gold color which has a yellow component in the range of about 17.7 to about 20.5 CIE units, and a red component in the range of about 2.6 to about 4.0 CIE units; and said composition being capable of being selectively hardened to at least 150% of its annealed hardness.

5. A bangle closing mechanism as set forth in claim 2 wherein said keeper bar is formed of a hardenable gold-based alloy composition, consisting essentially of:

not less than about 58.03 weight percent gold;

not less than about 10.0 weight percent silver;

not less than about 2.0 weight percent zinc;

not less than about 0.2 weight percent cobalt;

not less than about 0.003 weight percent iridium;

copper in weight percent amount equal to 100 less the sum total of the weight percent of said gold, silver, zinc, cobalt and iridium;

the ratio of said copper amount to said silver amount being between about 2.0 about 3.8;

the ratio of said copper amount to the sum total of said silver amount plus twice said zinc amount being between about 1.3 and about 2.5;

said composition having a gold color which has a yellow component in the range of about 17.7 to about 20.5 CIE units, and a red component in the range of about 2.6 to about 4.0 CIE units; and said composition being capable of being selectively hardened to at least 150% of its annealed hardness.

6. A bangle closing mechanism as set forth in claim 2 wherein said keeper bar is formed of a gold-based alloy composition, consisting of:

not less than about 58.03 weight percent gold;

not less than about 10.0 weight percent silver;

not less than about 2.0 weight percent zinc;

not less than about 0.2 weight percent cobalt;

copper in weight percent amount equal to 100 less the sum total of the weight percent of said gold, silver, zinc and cobalt;

the ratio of said copper amount to said silver amount being between 2.0 and about 3.8; and the ratio of said copper amount to the sum total of said silver amount plus twice said zinc amount being between about 1.3 and 2.5.

7. A bangle closing mechanism as set forth in claim 2 wherein said keeper bar is formed of a gold-based alloy composition, consisting of:

not less than about 58.03 weight percent gold;

not less than about 10.0 weight percent silver;

not less than about 2.0 weight percent zinc;

not less than about 0.2 weight percent cobalt;

not less than about 0.003 weight percent iridium;

copper in weight percent amount equal to 100 less the sum total of the weight percent of said gold, silver, zinc, cobalt and iridium;

the ratio of said copper amount to said silver amount being between about 2.0 about 3.8; and the ratio of said copper amount to the sum total of said silver amount plus twice said zinc amount being between about 1.3 and 2.5.

8. A bangle closing mechanism as set forth in claim 2 wherein said keeper bar is formed of a gold-based alloy composition, the annealed hardness of which is capable of being restored by heating and quenching, consisting essentially of:

not less than about 58.03 weight percent gold;

not less than about 10.0 weight percent silver;

not less than about 2.0 weight percent zinc;

not less than about 0.2 weight percent cobalt;

copper in weight percent amount equal to 100 less the sum total of the weight percent of said gold, silver, zinc, and cobalt;

the ratio of said copper amount to said silver amount being between about 2.0 and about 3.8;

the ratio of said copper amount to the sum total of said silver amount plus twice said zinc amount being between about 1.3 and 2.5;

said composition having a gold color which has a yellow component in the range of about 17.7 to about 20.5 CIE units, and a red component in the range of about 2.6 to about 4.0 CIE units; and said alloy composition having a hardness in an annealed condition of less than about 180 VHN.

9. A bangle closing mechanism as set forth in claim 2 wherein said keeper bar is formed of a gold-based alloy composition, the annealed hardness of which is capable of being restored by heating and quenching, consisting essentially of:

not less than about 58.03 weight percent gold;

not less than about 10.0 weight percent silver;

not less than about 2.0 weight percent zinc;

not less than about 0.2 weight percent cobalt;

not less than about 0.003 weight percent iridium;

copper in weight percent amount equal to 100 less the sum total of the weight percent of said gold, silver, zinc, cobalt, and iridium;

the ratio of said copper amount to said silver amount being between about 2.0 and about 3.8;

the ratio of said copper amount to the sum total of said silver amount plus twice said zinc amount being between about 1.3 and 2.5;

said composition having a gold color which has a yellow component in the range of about 17.7 to about 20.5 CIE units, and a red component in the range of about 2.6 to about 4.0 CIE units; and said alloy composition having a hardness is an annealed condition of less than about 180 VHN.

10. A bangle closing mechanism as set forth in claim 1 wherein said keeper bar has a substantially-rectangular transverse cross-section bounded by a major dimension and a minor dimension.

11. A bangle closing mechanism as set forth in claim 10 wherein said keeper bar is arcuate about a point spaced from the keeper bar surface that occupies said major dimension.

12. A bangle closing mechanism as set forth in claim 11 wherein at least one of said bangle halves is arcuate, and wherein the radius of said keeper bar arcuate surface is substantially equal to the radius of the arcuate bangle half such that said keeper bar appears to be a continuous arcuate extension of said arcuate bangle half.

13. A bangle closing mechanism as set forth in claim 1 wherein said first bangle half has a narrowed opening in a marginal end portion, and wherein said keeper has a proximal marginal end portion passing through said first bangle half opening and operatively engaged with said first bangle half.

14. A bangle closing mechanism as set forth in claim 13 wherein said keeper bar proximal marginal end portion has two fork-like tines operatively arranged to be moved toward one another by overcoming the opposing bias of a spring.

15. A bangle closing mechanism as set forth in claim 14 wherein said keeper bar proximal marginal end portion has an enlarged arcuate surface operatively arranged to reduce the spring rate of said spring such that the relative flexibility of said tines will be enhanced.

16. A bangle closing mechanism as set forth in claim 14 and further comprising a pusher plate operatively arranged to be depressed for causing said tines to move toward one another.

17. A bangle closing mechanism as set forth in claim 13 wherein said proximal end portion of said keeper bar makes a click-like audible noise when it forcibly engages the first bangle half marginal end portion.

* * * * *